US007517051B2

(12) United States Patent
Kim et al.

(10) Patent No.: US 7,517,051 B2
(45) Date of Patent: Apr. 14, 2009

(54) METHOD OF FABRICATING INK JET HEAD AND INK JET HEAD FABRICATED THEREBY

(75) Inventors: Kyong-il Kim, Yongin-si (KR); Sungjoon Park, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 452 days.

(21) Appl. No.: 11/035,894

(22) Filed: Jan. 18, 2005

(65) Prior Publication Data

US 2005/0253900 A1 Nov. 17, 2005

(30) Foreign Application Priority Data

May 11, 2004 (KR) ..... 10-2004-0033231

(51) Int. Cl.
*B41J 2/16* (2006.01)

(52) U.S. Cl. ..... 347/47; 347/63

(58) Field of Classification Search ..... 347/58, 347/61–67, 20, 44, 47, 56
See application file for complete search history.

(56) References Cited

U.S. PATENT DOCUMENTS

| | | | | |
|---|---|---|---|---|
| 4,229,265 | A * | 10/1980 | Kenworthy | 205/50 |
| 4,550,326 | A * | 10/1985 | Allen et al. | 347/44 |
| 6,146,915 | A * | 11/2000 | Pidwerbecki et al. | 438/21 |
| 6,270,192 | B1 * | 8/2001 | Ma | 347/45 |
| 6,354,695 | B1 * | 3/2002 | Kim et al. | 347/48 |
| 6,634,737 | B2 * | 10/2003 | Sugioka | 347/58 |
| 6,902,259 | B2 * | 6/2005 | Chen et al. | 347/63 |
| 2001/0053501 | A1 * | 12/2001 | Chen et al. | 430/320 |
| 2002/0113846 | A1 * | 8/2002 | Wang et al. | 347/68 |
| 2003/0087199 | A1 * | 5/2003 | Kim et al. | 430/320 |
| 2004/0027424 | A1 * | 2/2004 | Kim | 347/64 |
| 2004/0233254 | A1 * | 11/2004 | Kim | 347/56 |
| 2005/0024439 | A1 * | 2/2005 | Fukunaga et al. | 347/55 |

(Continued)

FOREIGN PATENT DOCUMENTS

| | | |
|---|---|---|
| JP | 11-170547 | 6/1999 |

(Continued)

*Primary Examiner*—Juanita D Stephens
(74) *Attorney, Agent, or Firm*—Stanzione & Kim, LLP

(57) ABSTRACT

A method of fabricating an ink jet head and an ink jet head fabricated thereby. The method includes preparing a substrate having a flow path region, a flow path structure region to define the flow path region, and a pad region disposed at edge portions of the substrate. At least one pressure-generating element to eject ink is formed on the substrate of the flow path region. An inserting material layer is formed on an entire surface of the substrate having the at least one pressure-generating element. The inserting material layer is patterned to form an inserting layer on the flow path structure region. A mold layer is formed on the substrate having the inserting layer to cover the flow path region. Next, a nozzle material layer is formed on the entire surface of the substrate having the inserting layer and the mold layer. The nozzle material layer is patterned to form a nozzle layer covering the inserting layer and the mold layer and having at least one nozzle passing through the nozzle material layer on the mold layer to correspond to the at least one pressure-generating element.

17 Claims, 8 Drawing Sheets

U.S. PATENT DOCUMENTS

| | | | | |
|---|---|---|---|---|
| 2005/0052502 | A1* | 3/2005 | Chung et al. | 347/65 |
| 2005/0083372 | A1* | 4/2005 | Obert et al. | 347/47 |
| 2005/0185017 | A1* | 8/2005 | Keenan et al. | 347/40 |
| 2006/0164495 | A1* | 7/2006 | Tanaka | 347/112 |
| 2006/0176338 | A1* | 8/2006 | Deguchi et al. | 347/43 |

FOREIGN PATENT DOCUMENTS

| | | |
|---|---|---|
| JP | 2002-160373 | 6/2002 |
| JP | 2003-89209 | 3/2003 |
| KR | 2004-743 A | 1/2004 |

* cited by examiner

METHOD OF FABRICATING INK JET HEAD AND INK JET HEAD FABRICATED THEREBY

CROSS-REFERENCE TO RELATED APPLICATIONS

This application claims the benefit of Korean Patent Application No. 2004-33231, filed May 11, 2004, the disclosure of which is hereby incorporated herein by reference in its entirety.

BACKGROUND OF THE INVENTION

1. Field of the Invention

The present general inventive concept relates to a method of fabricating an ink jet head and an ink jet head fabricated thereby and, more particularly, to a method of fabricating an ink jet head and an ink jet head fabricated thereby, provided with an inserting layer pattern to flatten a nozzle layer.

2. Description of the Related Art

An ink jet recording device functions to print an image by ejecting fine droplets of ink for printing to a desired position on a recording medium. Such an ink jet recording device has been widely used since its price is low and numerous kinds of colors may be printed at a high resolution. The ink jet recording device basically includes an ink jet head for actually ejecting the ink and an ink container in fluid communication with the ink jet head. The ink stored in the ink container is supplied into the ink jet head through an ink supply hole, and the ink jet head ejects the ink supplied from the ink container onto the recording medium to thereby complete the printing operation.

A process of fabricating the ink jet head may be classified into a hybrid type and a monolithic type depending upon a method of forming a chamber layer and a nozzle layer configuring the ink jet head. In the case of the hybrid type, a process of forming the chamber layer on a substrate having a pressure-generating element, such as a heat-generating unit, and a process of forming the nozzle layer having a nozzle for ejecting the ink are individually progressed. Next, the nozzle layer is adhered on the chamber layer to thereby complete the fabrication of the ink jet head. However, in the process of adhering the nozzle layer on the chamber layer, misalignment between the pressure-generating element and the nozzle is likely to occur. In addition, the process becomes complicated since the chamber layer and the nozzle layer are fabricated through different processes. To overcome these problems, a method fabricating the monolithic type ink jet head has been widely employed.

FIGS. 1 to 4 are cross-sectional views illustrating a method of fabricating a conventional monolithic type ink jet head.

Referring to FIG. 1, a heat-generating unit 102 for ink ejection is formed on a substrate 100. Next, a positive photoresist layer is formed on an entire surface of the substrate, and then the positive photoresist layer is exposed and developed to form a mold layer 104 on the substrate 100, for covering a region where a flow path is to be formed.

Referring to FIG. 2, a negative photoresist layer 106 is formed on the entire surface of the substrate 100 having the mold layer 104. As shown in FIG. 2, during the fabrication process, the negative photoresist layer 106 has an uneven thickness due to a step-difference formed between the substrate 100 and the mold layer 104. In particular, the thickness of the negative photoresist layer 106 becomes rapidly thinned at an upper portion of an edge portion E of the mold layer 104.

Referring to FIG. 3, the negative photoresist layer 106 is exposed by a photomask provided with a nozzle pattern, and patterned by a development process. As a result, as shown in FIG. 3, a flow path structure 106' has at least one nozzle 108 for ejecting the ink formed at the upper portion thereof.

Referring to FIG. 4, the substrate 100 is etched to form an ink supply hole 110 passing through the substrate 100, and then the mold layer 104 is removed using an appropriate solvent. As a result, an ink chamber 112 and a restrictor 114 are formed at a region where the mold layer 104 was removed.

As described above, according to the conventional method, the mold layer 104 is previously formed at the region where the flow path including the ink chamber 112 and the restrictor 114 is to be formed, and then the negative photoresist layer 106 is formed. As a result, as shown in FIG. 4, the flow path structure 106' fabricated by the process described above has an uneven height from the substrate 100. In particular, the flow path structure 106' has an uneven thickness at an upper portion of the flow path including the ink chamber 112 and the restrictor 114. That is, the thickness of the flow path structure 106' becomes thinner as it gets nearer to an edge of the flow path. As a result, when the nozzle 108 passing through the upper portion of the flow path structure 106' is formed, the height of the nozzle may have an uneven distribution to deteriorate ink ejection properties. In addition, as the thickness of the flow path structure 106' becomes rapidly thin at the edge portion E of the flow path, when pressure generated at the time the ink is ejected is repeatedly applied, the flow path structure 106' on the edge portion E of the flow path may have mechanical defects.

SUMMARY OF THE INVENTION

The present general inventive concept provides a method of fabricating an ink jet head capable of evenly controlling a thickness of a nozzle formed at a nozzle layer and preventing the nozzle layer from mechanically weakening by forming the nozzle layer having a flat upper surface.

The present general inventive concept also provides an ink jet head fabricated by the same method.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a method of fabricating an ink jet head provided with an inserting layer to flatten a nozzle layer. The method includes preparing a substrate having a flow path region, a flow path structure region to define the flow path region, and a pad region disposed at edge portions of the substrate. At least one pressure-generating element for ink ejection is formed on the substrate of the flow path region. An inserting material layer is formed on an entire surface of the substrate having the at least one pressure-generating element. The inserting material layer is patterned to form an inserting layer on the flow path structure region. A mold layer is formed on the substrate having the inserting layer to cover the flow path region. Next, a nozzle material layer is formed on the entire surface of the substrate having the inserting layer and the mold layer. The nozzle material layer is patterned to form a nozzle layer covering the inserting layer and the mold layer and having at least one nozzle passing through the nozzle material layer to correspond to the at least one pressure-generating element.

Furthermore, the present general inventive concept may further include forming at least one pad to transmit electrical signals to the at least one pressure-generating element on the pad region of the substrate before forming the inserting material layer. In this case, the inserting layer may be formed on the flow path structure region by the patterning process of the inserting material layer, and at the same time, at least one pad damper to prevent exterior interconnection lines from shorting to the substrate may be formed on the pad region.

The inserting layer is previously formed to have a predetermined thickness on the substrate before the mold layer is formed to compensate a step-difference formed between the substrate and the mold layer formed by a subsequent process. Therefore, it is an aspect of the present general inventive concept that the inserting layer can be formed to have a thickness equal to the mold layer. In addition, it is an aspect that the inserting layer can be formed on the flow path structure region, being spaced apart from the flow path region by a predetermined distance.

The foregoing and/or other aspects and advantages of the present general inventive concept are achieved by providing an ink jet head with an inserting layer to flatten a nozzle layer. The ink jet head is provided with a substrate having a flow path region, a flow path structure region to define the flow path region, and a pad region disposed at edge portions of the substrate. At least one pressure-generating element for ink ejection is disposed on the substrate of the flow path region. An inserting layer is disposed on the flow path structure region. A nozzle layer covers the inserting layer and extends toward an upper portion of the flow path region to define atop surface of the flow path. At least one nozzle passing through a nozzle layer pattern to correspond to the at least one pressure-generating element is disposed at the nozzle layer.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
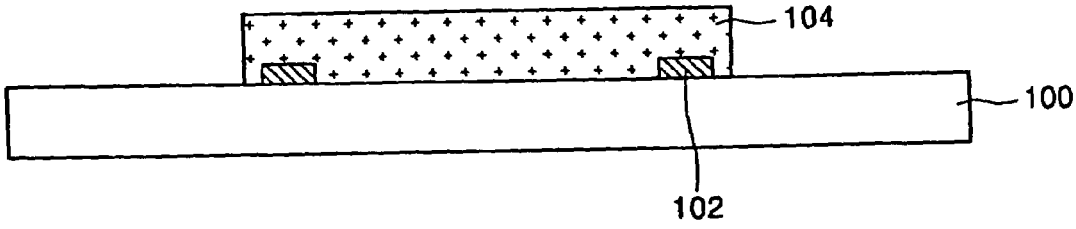
FIG. 1 (PRIOR ART)
FIGS. 1 to 4 are cross-sectional views illustrating a method of fabricating a conventional monolithic type ink jet head.
Figure 2:
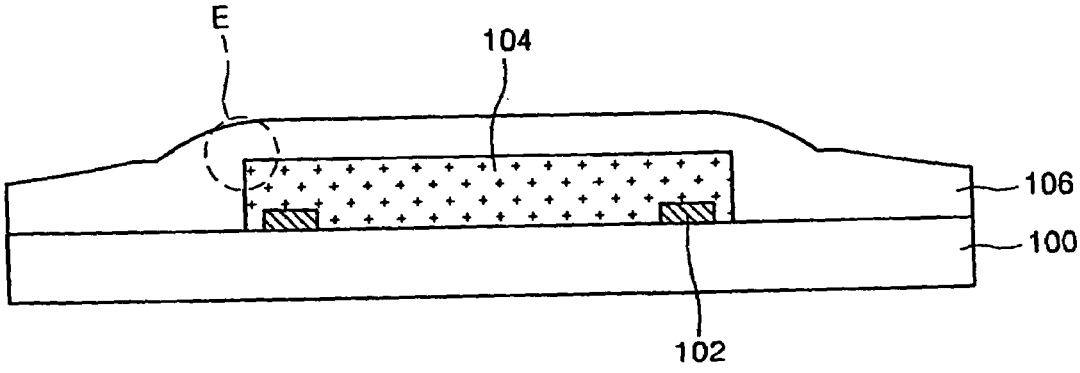
FIG. 2 (PRIOR ART)
Figure 3:
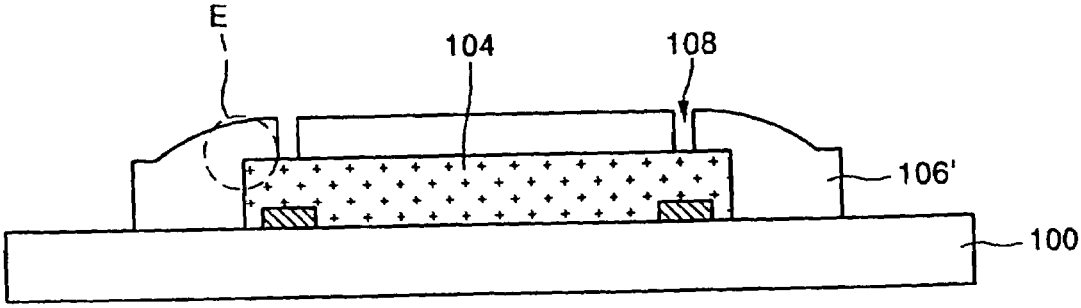
FIG. 3 (PRIOR ART)
Figure 4:
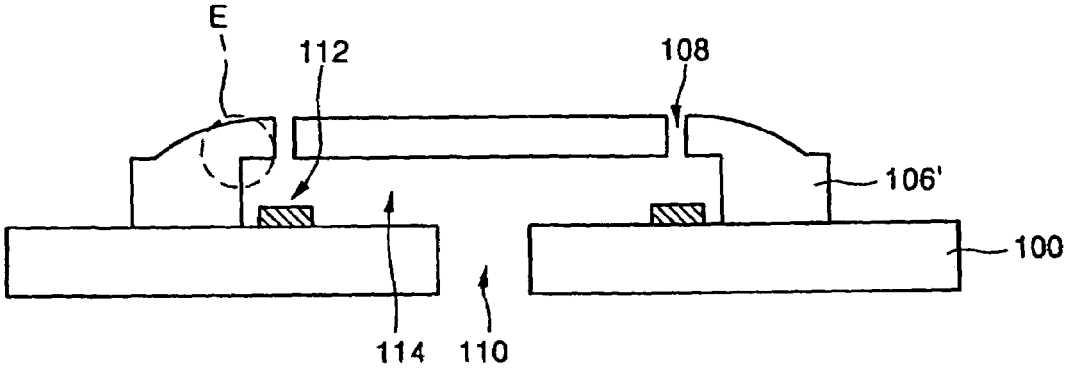
FIG. 4 (PRIOR ART)

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 5:
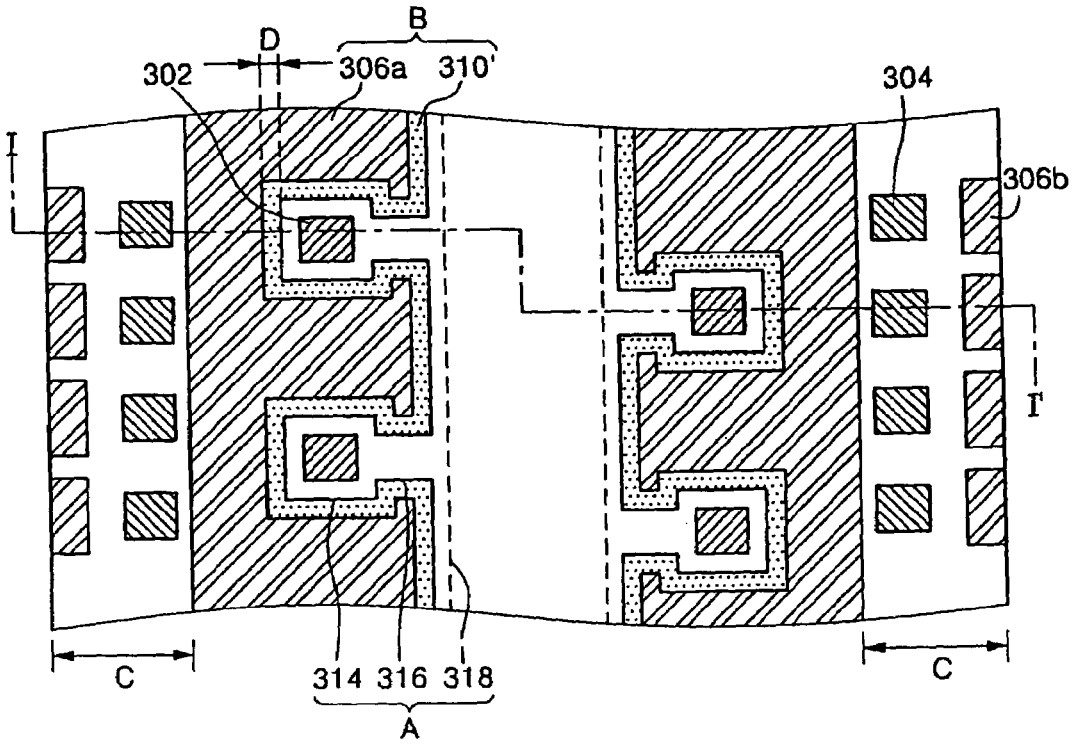
FIG. 5 is a partial plan view of an ink jet head in accordance with an embodiment of the present general inventive concept.

FIG. 5 is a partial plan view of an ink jet head in accordance with an embodiment of the present general inventive concept, and FIGS. 6 to 13 are cross-sectional views illustrating a method of fabricating an ink jet head in accordance with an embodiment of the present general inventive concept. FIGS. 6 to 13 are cross-sectional views taken along the line I-I' of FIG. 5.

Figure 6:
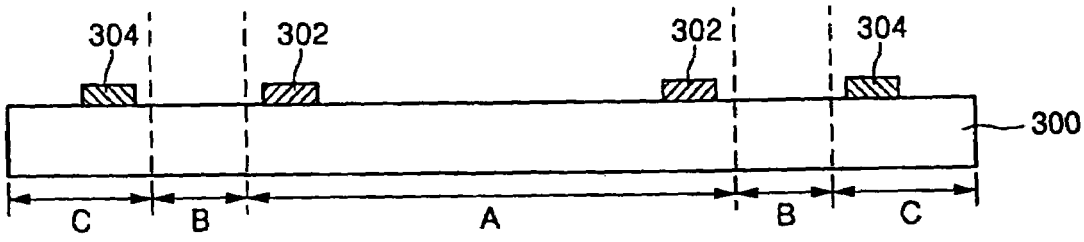
FIGS. 6 to 13 are cross-sectional views illustrating a method of fabricating an ink jet head in accordance with an embodiment of the present general inventive concept.

Referring to FIGS. 5 and 6, a substrate 300 is prepared. The substrate 300 can be a silicone substrate widely used in a semiconductor manufacturing process. The substrate 300 includes a flow path region A, a flow path structure region B, and a pad region C. The flow path region A is a region where a flow path to provide a moving passage of ink is formed by a subsequent process. The flow path region A may include an ink chamber 314, a restrictor 316, and an ink supply hole 318. The flow path structure region B is a region where a flow path structure to define the flow path is formed by a subsequent process. In embodiments of the present general inventive concept, the flow path structure includes an inserting layer 306*a* and a nozzle layer 310'. More specifically, the flow path structure region B is a region where a sidewall portion of the flow path structure is formed. In FIG. 5, the flow path structure region B is a region designated to both the inserting layer 306*a* and the nozzle layer 310'. In addition, the pad region C is a region where a pad 304 connected to external interconnection lines to drive the ink jet head is to be formed, and may be disposed at edge portions of the substrate 300. As shown in FIG. 5, the pad region C may be disposed at both latitudinal edge portions of the substrate 300. However, unlike that shown in FIG. 5, the pad region C may be disposed at both longitudinal edge portions of the substrate 300.

A plurality of pressure-generating elements 302 to eject the ink is formed on the substrate 300 at the flow path region A. In addition, the substrate 300 at the pad region C may be formed with pads 304 to transmit electrical signals to the pressure-generating elements 302. In the embodiments of the present general inventive concept, the pressure-generating elements 302 may be formed as a heat-generating unit. The heat-generating unit may be made of a metal with high resistance such as a tantalum-aluminum alloy. The pressure-generating elements 302 and the pads 304 may be formed in various manners by methods known to those skilled in the art. Therefore, the present general inventive concept is not limited by the process of forming the pressure-generating elements 302 and the pads 304. The pressure-generating elements 302 and the pads 304 may be formed by, for example, the following process. First, a high-resistance metal layer and an interconnection line layer, such as an aluminum layer, are sequentially formed on the substrate 300. Then, the interconnection line layer and the high-resistance metal layer are anisotropically etched to form the pads 304 at the pad region C, and simultaneously, a stacked metal pattern is electrically connected to each pad 304. The stacked metal pattern includes a high-resistance metal pattern and an interconnection line layer pattern, which are sequentially stacked. Next, the interconnection line layer pattern is selectively etched to partially expose the high-resistance metal layer pattern. The exposed region of the high-resistance metal layer pattern is provided for the pressure-generating elements 302 to generate heat energy for ink ejection.

Although not shown, a heat barrier layer, such as a silicone oxide layer, may be formed on the substrate 300 before forming the high-resistance metal layer. In addition, after forming the pressure-generating elements 302, a passivation layer may be formed to protect the pressure-generating elements 302 and the interconnection line layer pattern.

Figure 7:
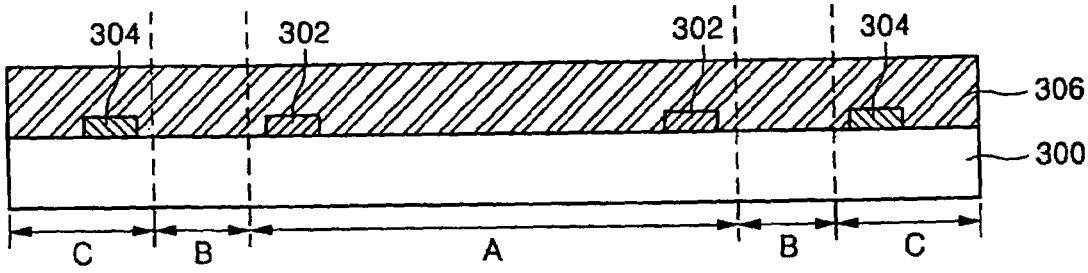

Referring to FIGS. 5 and 7, an inserting material layer 306 is formed on an entire surface of the substrate 300 having the pressure-generating elements 302 and the pads 304. The inserting material layer 306 may be made of a thermosetting resin or a negative photoresist. The inserting material layer 306 may be made of a material layer such as a nozzle layer formed by the subsequent process, or may be made of an epoxy-based, polyimid-based or polyacrylate-based photoresist.

Figure 8:
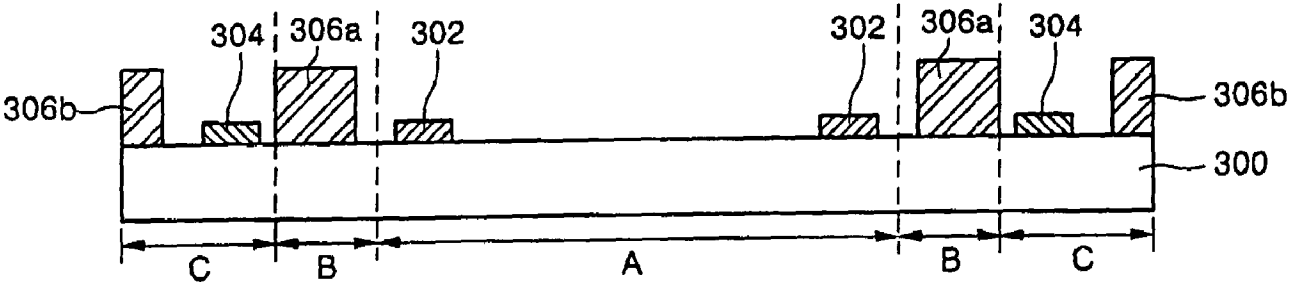

Referring to FIGS. 5 and 8, the inserting material layer 306 is patterned to form an inserting layer 306*a* on the flow path structure region B. The inserting material layer 306 may be patterned by a conventional anisotropic etching or exposure/development process. As described above, the inserting material layer 306 may be made of a negative photoresist. In this case, the inserting layer 306*a* may be formed by selectively UV exposing a region where the inserting layer 306*a* is to be formed using a photomask, and removing an unexposed region using an appropriate solvent. The solvent for elimination of the unexposed region may employ a developer, acetone, a solvent including a halogen element, or an alkaline solvent.

The thickness and arrangement of the inserting layer 306*a* may be determined under consideration of a role of the inserting layer 306*a* and a relationship with a mold layer, which is to be formed by the subsequent process. Therefore, the thickness and arrangement of the inserting layer 306*a* will be described hereinafter.

Meanwhile, in accordance with embodiments of the present general inventive concept, the inserting material layer 306 may be patterned to form the inserting layer 306*a*, and at the same time, pad dampers 306*b* corresponding to each of the pads 304 may be further formed at edge portions of the substrate 100 adjacent to the pads 304. In a packaging process of bonding external interconnection lines to the pads 304 in a Tape Automated Bonding (TAB) manner, the pad dampers 306*b* are formed to prevent the external interconnection lines from electrically shorting to the substrate 300. In accordance with the embodiments of the present general inventive concept, the inserting material layer 306 may be patterned one time to simultaneously form the inserting layer 306*a* and the pad dampers 306*b*. Therefore, a separate process to form the pad dampers 306*b* may be omitted to more simplify the process of fabricating the ink jet head. The pad dampers 306*b* are made of the same material and have the same thickness as the inserting layer 306*a*.

Figure 9:
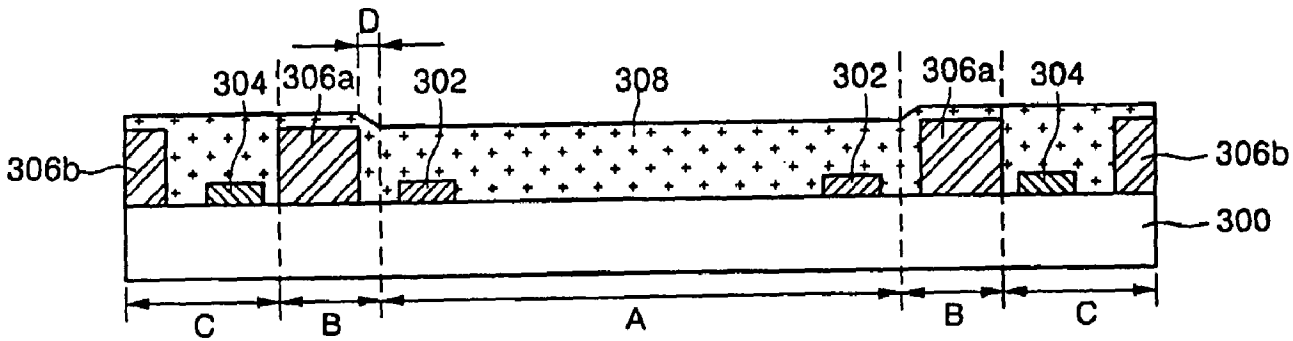

Referring to FIGS. 5 and 9, a mold material layer 308 is formed on an entire surface of the substrate having the inserting layer 306*a*. The mold material layer 308 can be made of a positive photoresist.

Figure 10:
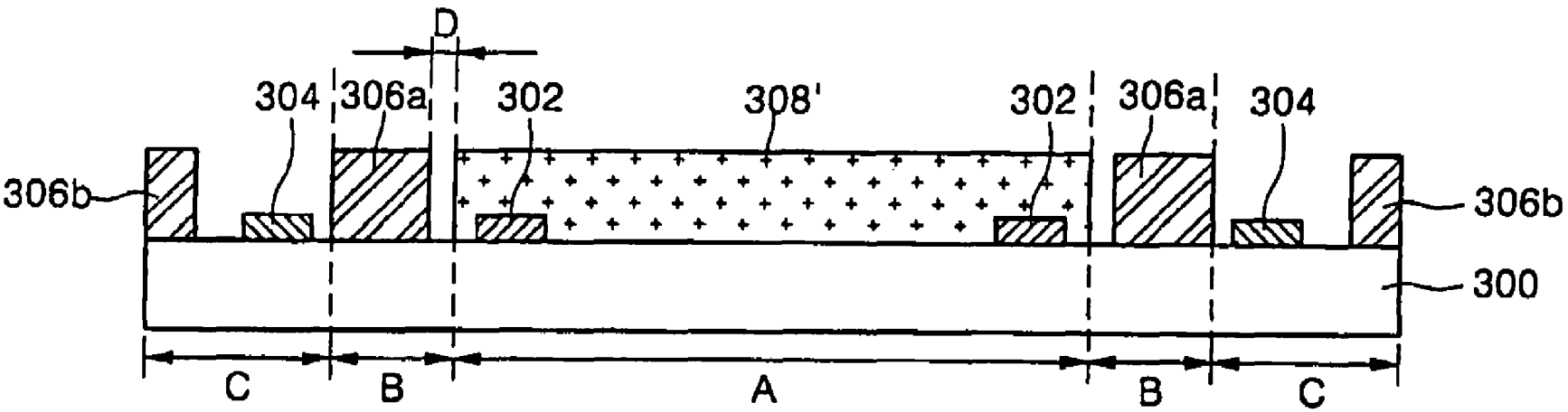

Referring to FIGS. 5 and 10, the mold material layer 308 is patterned to form a mold layer 308' covering an upper surface of the flow path region A as a whole. The mold material layer 308 can be made of a positive photoresist, and may be patterned by the conventional exposure and development processes.

The inserting layer 306*a* shown in FIG. 8 is formed to compensate a step-difference formed between the mold layer 308' and the substrate 300. In general, when the photoresist layer or another type layer are formed on the substrate 300 using a method such as a spin coating method, surface morphology of the layer formed on the substrate 300 is affected by a lower structure. Therefore, as shown in FIG. 10, when the mold layer 308' having a predetermined thickness is formed on the substrate 300, a layer subsequently formed on the substrate 300 becomes affected by a step-difference formed between the substrate 300 and the mold layer 308'. In accordance with the present embodiment, before forming the mold layer 308', the inserting layer 306*a* having a predetermined thickness is previously formed on the flow path structure region B, so that the subsequently formed layer has a flatter upper surface morphology than without the inserting layer 306*a*.

As described above, the inserting layer 306*a* is formed to compensate the step-difference formed between the mold layer 308' and the substrate 300. Therefore, the thickness of the inserting layer 306*a* preferably has a value equal to or similar to the thickness of the mold layer 308' within a range of which the layer formed on the inserting layer 306*a* and the mold layer 308' by a subsequent process may have a flat upper surface morphology. The present general inventive concept may have the most preferable effect when the inserting layer 306*a* has the same thickness as the mold layer 308'. In an actual process, when a height of the flow path is previously determined, the mold layer 308' is formed to have such a thickness. In addition, the inserting layer 306*a* also preferably has the same thickness under the consideration of the previously determined thickness of the mold layer 308'.

Furthermore, the inserting layer 306*a* formed on the flow path structure region B may be formed to cover the entire surface of the flow path structure region B or formed on only a partial surface of the flow path structure region B as long as the function as described above may be performed. When the inserting layer 306*a* is formed to cover the entire surface of the flow path structure region B, one sidewall of the inserting layer 306*a* may constitute a sidewall of the flow-path formed by the subsequent process. As shown in FIG. 9, the inserting layer 306*a*may be formed to be spaced apart from the flow path region A by a predetermined distance D. The inserting layer 306*a* is previously formed before forming the mold material layer 308. Therefore, when the mold material layer 308 is formed after forming the inserting layer 306*a*, the mold material layer 308 may be affected by the step-difference formed between the inserting layer 306*a* and the substrate 300. Therefore, as shown FIG. 10, the mold layer 308' having the flat upper surface morphology may be formed by arranging the inserting layer 306*a* to space apart from the flow path region A without the affection of the step-difference formed between the inserting layer 306*a* and the substrate 300.

Furthermore, although not shown, the inserting layer 306*a* may be formed to have a stacked structure of at least two layers. For example, a first inserting layer 306*a* may be formed to cover the entire surface of the flow path structure region B, and then a second inserting layer 306*a* may be formed spaced apart from the flow path region A by a predetermined distance on the first inserting layer 306*a*.

Figure 11:
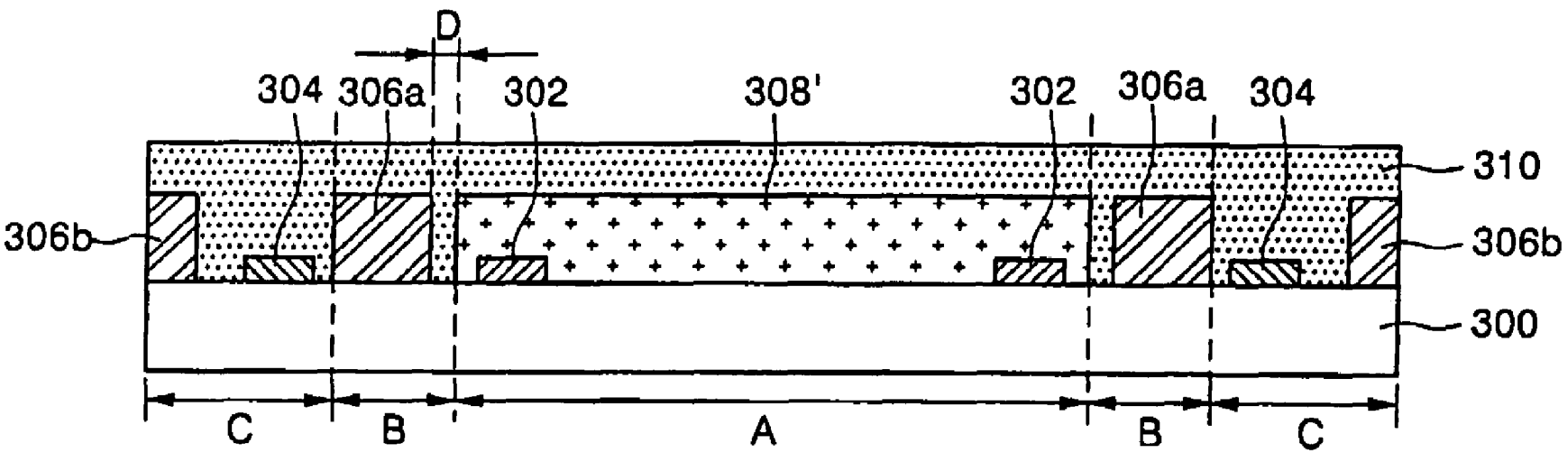

Referring to FIGS. 5 and 11, a nozzle material layer 310 is formed on the entire surface of the substrate 300 having the inserting layer 306*a* and the mold layer 308'. The mold material layer 310 may be made of a negative photoresist such as an epoxy-based, polyimid-based, or polyacrylate-based photoresist. The nozzle material layer 310 can be made of the same material layer as the inserting layer 306*a*. In accordance with the embodiments of the present general inventive concept, both the inserting layer 306*a* and the nozzle material layer 310 may be made of a negative photoresist. The inserting layer 306*a* and the nozzle material layer 310 are formed of the same material layer, so that it is possible to achieve good adhesive properties.

In accordance with the embodiments of the present general inventive concept, before forming the nozzle material layer 310, the inserting layer 306*a* is formed to compensate the step formed between the mold layer 308' and the substrate 300. Therefore, the nozzle material layer 310 has the flat upper surface morphology as shown in FIG. 11. In particular, the nozzle material layer 310 has the flat upper surface morphology on an upper portion of the mold layer 308'.

Figure 12:
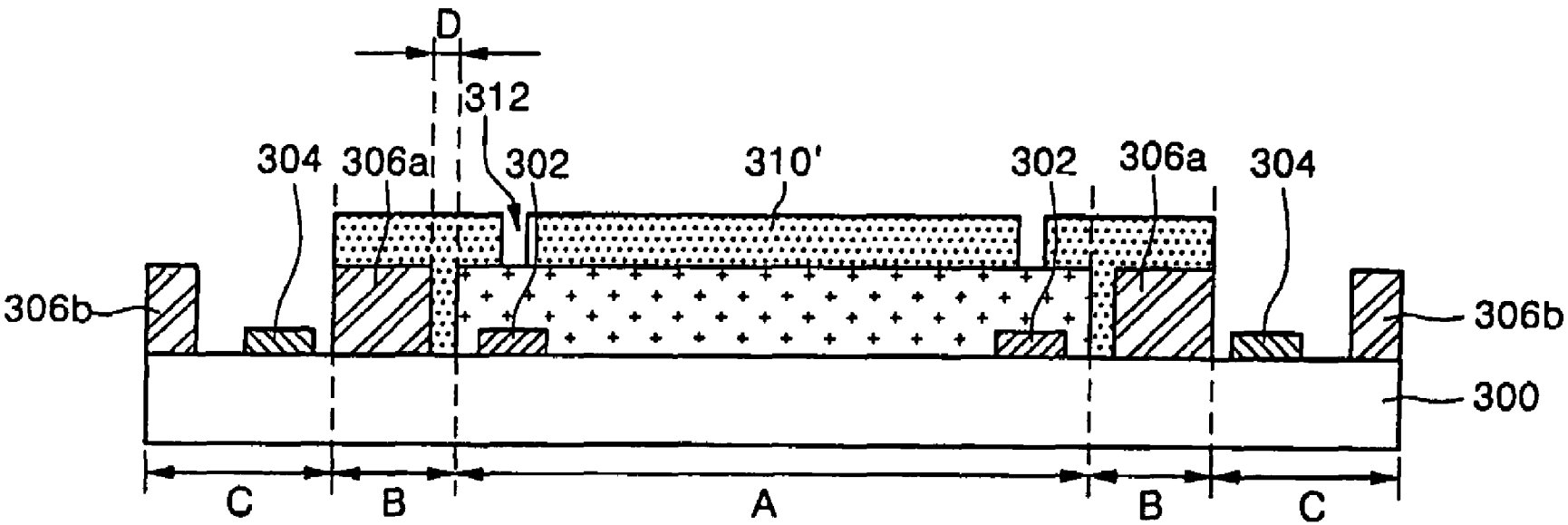

Referring to FIGS. 5 and 12, the nozzle material layer 310 is patterned to form a nozzle layer 310' having nozzles 312 corresponding to the pressure-generating elements 302. More specifically, the nozzle material layer 310 is subjected to exposure using a photomask provided with a nozzle pattern and a pad region pattern. A light source of the exposure process may employ UV light. Next, an unexposed region is removed by an appropriate solvent. A solvent to remove the unexposed region, that is, the nozzle material layer 310 of a region intended to form the nozzles and the pad region may employ developer, acetone, a solvent including a halogen element, or an alkaline solvent.

As a result, as shown in FIG. 12, the nozzle layer 310' having the nozzles 312 to eject ink is formed to cover the inserting layer 306*a* and the mold layer 308. In accordance with the embodiments of the present general inventive concept, the nozzle layer 310' configures the flow path structure to define the flow path together with the inserting layer 306*a*. As described above, the nozzle material layer 310 has the flat upper surface morphology. As a result, the nozzle layer 310' formed by patterning the nozzle material later 310 also has the flat upper surface morphology, and the nozzles 312 passing through the nozzle material layer 310 are also formed to have an even height. In addition, as the thickness of the nozzle layer 310' is evenly maintained along both edge portions of the mold layer 308', formation of a mechanical weak point of the nozzle layer 310' may be prevented.

Figure 13:
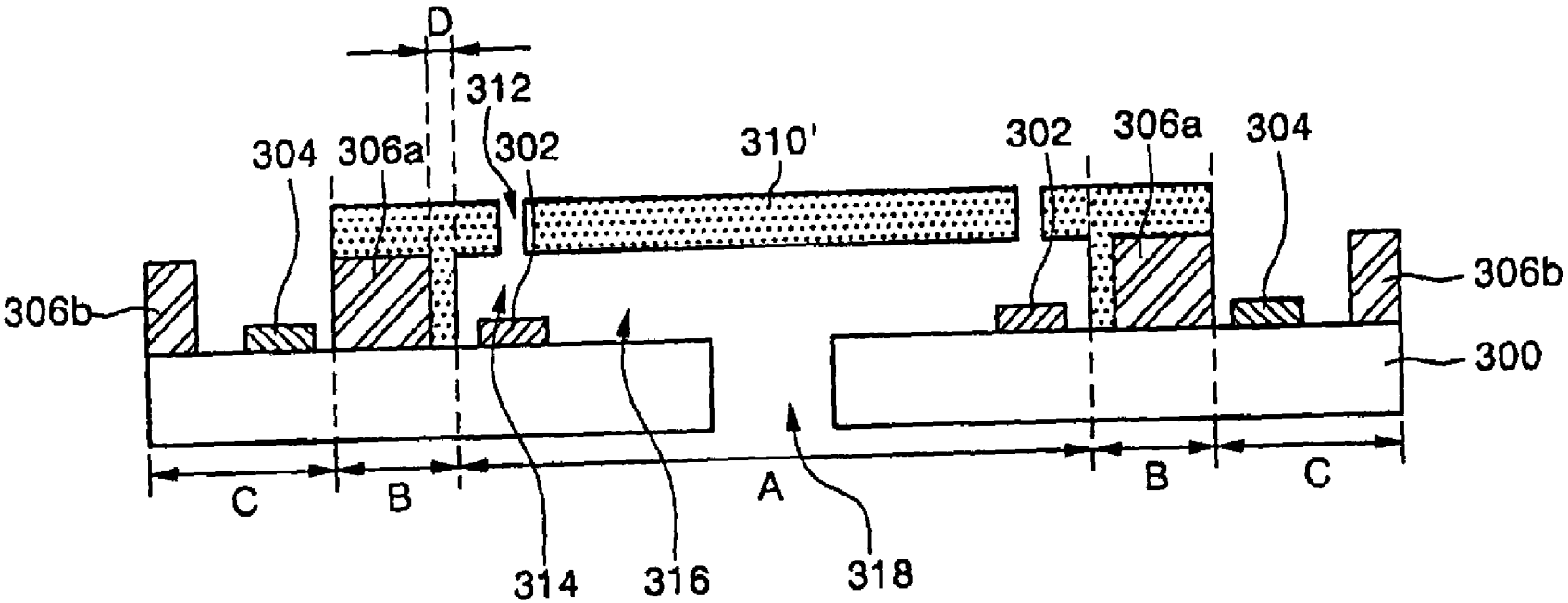

Referring to FIGS. 5 and 13, after forming the nozzle layer 310', the substrate 300 corresponding to a center portion of the flow path region A is etched to form an ink supply hole 318. The substrate 300 may be etched by a dry etching process using XeF2 or BF3 gases as an etching gas. Next, the mold layer 308' is removed using an appropriate solvent to form the ink chamber 314 and the restrictor 316 in the flow path region A.

Hereinafter, an ink jet head in accordance with embodiments of the present general inventive concept will be described with reference to FIGS. 5 and 13.

Referring to FIGS. 5 and 13, a substrate 300 is prepared. The substrate 300 has a flow path region A, a flow path structure region B to define the flow path region A, and a pad region C disposed at edge portions of the substrate 300. Pressure-generating elements 302 to generate pressure for ink ejection are disposed on the substrate 300 of the flow path region A. In accordance with the embodiments of the present general inventive concept, each of the pressure-generating elements 302 may be a heat-generating unit. The heat-generating unit may be made of a high-resistance metal such as a tantalum-aluminum alloy. Pads 304 to transmit electrical signals to the pressure-generating elements 302 may be disposed on the substrate of the pad region C. The pads 304 may be made of, for example, aluminum. An inserting layer 306*a* having a predetermined thickness is disposed on the flow path structure region B. The inserting layer 306*a* may be made of a thermosetting resin or a negative photoresist. Preferably, the inserting layer 306*a* may be made of a negative photoresist such as an epoxy-based, polyimid-based or polyacrylate-based photoresist. Although the inserting layer 306*a* may be disposed to cover the entire region of the flow path structure region B, the inserting layer 306*a* can also be disposed to be spaced apart from the flow path region A by a predetermined distance D, as shown in FIG. 13.

In the meantime, pad dampers 306*b* may be disposed at the pad region C. The pad dampers 306*b* are disposed on edge portions of the substrate 300 adjacent to the pads 304, and formed during the same process as the inserting layer 306*a*. Therefore, the pad dampers 306*b* are made of the same material and have the same thickness as the inserting layer 306*a*. The pad dampers 306*b* function to prevent the external interconnection lines from electrically shorting to the substrate 300 in a process of bonding the external interconnection lines to the pads 304 in a Tape Automated Bonding (TAB) manner during the package process.

A nozzle layer 310' is disposed on the inserting layer 306*a*. The nozzle layer 310' may be made of the same material as the inserting layer 306*a*, which can be a negative photoresist such as an epoxy-based, polyimid-based, or polyacrylate-based photoresist. The nozzle layer 310' is disposed on the inserting layer 306*a*, and extends toward an upper portion of the flow path region A to define the upper surface of the flow path to provide a moving passage of ink. In accordance with the embodiments of the present general inventive concept, the flow path includes an ink chamber 314 and a restrictor 316 defined in a separated space between the nozzle layer 310' and the substrate 300. In addition, the flow path may further include an ink supply hole 318 passing through the substrate 300 of the center portion of the flow path region A to be fluidly connected to the ink chamber 314 and the restrictor 316. Preferably, the nozzle layer 310' has a flat upper surface morphology. In addition, the nozzle layer 310' may be disposed to cover sidewalls of the inserting layer 306*a*. In this case, the nozzle layer 310' configures a sidewall surface and an upper surface of the flow path. In accordance with the embodiments of the present general inventive concept, the nozzle layer 310' configures a flow path structure together with the inserting layer 306*a* to provide the flow path on the substrate. In accordance with the embodiments of the present general inventive concept, the height of the flow path has a value equal to the thickness of the inserting layer 306*a*. However, it is not limited to the foregoing, and the thickness of the inserting layer 306*a* may have a value different from the height of the flow path within a range of which the nozzle layer 310' may have the flat upper surface morphology. The nozzle layer 310' is provided with at least one nozzle passing through the nozzle layer 310' to correspond to the pressure-generating elements 302.

The ink supplied from an ink container such as a cartridge (not shown) sequentially passes through the ink supply hole 318 and the restrictor 316 to be temporarily stored in the ink chamber 314. The ink stored in the ink chamber 314 is instantly heated by the heat-generating unit, i.e., the pressure-generating element 302 to be ejected through the nozzle 312 in a shape of a droplet. In accordance with the embodiments of the present general inventive concept, the nozzle layer 310' has the flat upper surface morphology by means of the inserting layer 306*a* disposed at the same level as the flow path including the ink chamber 314 and the restrictor 316. Therefore, the nozzles 312 disposed to pass through the nozzle layer 310' may have an even height. In addition, as the nozzle layer 310' maintains an appropriate thickness at the edge portion of the flow path, it is possible to prevent the nozzle layer 310' from mechanically weakening at the edge portion of the flow path.

As can be seen from the foregoing, the ink jet head in accordance with the present general inventive concept may form the nozzle layer having the flat upper surface morphology. Therefore, the thickness of the nozzle formed at the nozzle layer may be evenly controlled, and it is possible to prevent the nozzle layer from mechanically weakening.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An ink jet head comprising:

a substrate having a flow path region, a flow path structure region to define the flow path region, and a pad region disposed at edge portions of the substrate;

at least one pressure-generating element disposed on the substrate at the flow path region;

a nozzle layer enclosing the pressure-generating element, the nozzle layer having a sidewall surface to define an ink flow path in the flow path region of the substrate and an upper surface in unitary formation with the sidewall surface and having at least one nozzle respectively formed thereon corresponding to the pressure-generating element; and an inserting layer disposed on the flow path structure region to have a predetermined thickness and supporting the nozzle layer outside the ink flow path.

2. The ink jet head according to claim 1, wherein the inserting layer has a thickness equal to a height of the flow path.

3. The ink jet head according to claim 2, wherein the inserting layer is disposed on the flow path structure region to be spaced apart from the flow path by a predetermined distance.

4. The ink jet head according to claim 3, wherein the nozzle layer covers the inserting layer and extends toward the flow path region to simultaneously configure an upper surface and sidewall surfaces of the flow path.

5. The ink jet head according to claim 1, wherein the inserting layer is made of a negative photoresist or a thermosetting resin.

6. The ink jet head according to claim 1, wherein the nozzle layer is made of the same material layer as the inserting layer.

7. The ink jet head according to claim 6, wherein the nozzle layer is made of a negative photoresist.

8. The ink jet head according to claim 1, further comprising:

at least one pad disposed on the substrate of the pad region to transmit electrical signals to the at least one pressure-generating element; and at least one pad damper disposed on an edge portion of the substrate adjacent to the at least one pad to prevent external interconnection lines from shorting to the substrate.

9. The ink jet head according to claim 8, wherein the at least one pad damper is made of the same material as the inserting layer.

10. The ink jet head according to claim 1, wherein the at least one pressure-generating element is formed as a heat-generating unit.

11. The ink jet head according to claim 10, wherein the heat-generating unit is made of tantalum-aluminum alloy.

12. The inkjet head according to claim 1, wherein the nozzle layer is in contact with the substrate at the sidewall surface to define the ink flow path.

13. The inkjet head according to claim 1, wherein the nozzle layer comprises a first portion defining a sidewall surface defining the ink flow path and an upper surface having the at least one nozzle formed thereon, and a second portion in unitary formation with the first portion and remote from the substrate, the second portion extending from the first portion outside the ink flow path to be supported by the inserting layer thereat.

14. The inkjet head comprising:

a substrate;

nozzle layer defining an ink flow path on the substrate, the nozzle layer to eject ink from the ink flow path through at least one nozzle formed thereon, and an inserting layer removed from the ink flow path by the nozzle layer and to support the nozzle layer thereunder.

15. the inkjet head according to claim 14, wherein the nozzle layer is in contact with the substrate to define the ink flow path.

16. The inkjet head according to claim 14, wherein the nozzle layer includes a sidewall surface defining the ink flow path and an upper surface in unitary formation with the sidewall surface having the at least one nozzle formed thereon.

17. The inkjet head according to claim 14, wherein the nozzle layer comprises a first portion defining a sidewall surface defining the ink flow path and an upper surface having the at least one nozzle formed thereon, and a second portion in unitary formation with the first portion and remote from the substrate, the second portion extending from the first portion outside the ink flow path to be supported by the inserting layer thereat.

* * * * *